United States Patent [19]

Henson

[11] Patent Number: 4,836,332

[45] Date of Patent: Jun. 6, 1989

[54] FOLDABLE SAWHORSE

[76] Inventor: Robert M. Henson, 9170 State Hwy. 208, San Angelo, Tex. 76905

[21] Appl. No.: 184,674

[22] Filed: Apr. 22, 1988

[51] Int. Cl.[4] ..... B27B 21/00; B25H 1/06

[52] U.S. Cl. ..... 182/155; 182/225

[58] Field of Search ..... 182/155, 181–185, 182/225

[56] References Cited

U.S. PATENT DOCUMENTS

| | | | |
|---|---|---|---|
| 1,261,007 | 4/1918 | Beardsley | 182/184 |
| 1,486,169 | 3/1924 | Trautschold | 182/155 |
| 1,798,548 | 3/1931 | McCurdy | 182/155 |
| 2,410,330 | 10/1946 | Ashenfelter | 182/182 |
| 3,601,224 | 12/1961 | Barras | 182/182 |
| 3,738,451 | 6/1973 | Kirkpatrick | 182/155 |
| 4,183,317 | 1/1980 | Follick | 182/185 |

*Primary Examiner*—Reinaldo P. Machado
*Attorney, Agent, or Firm*—Marcus L. Bates

[57] ABSTRACT

An improved sawhorse has a horizontal central member supported at each end thereof by a special support assembly. Each of the support assemblies have a hinge formed at an upper end thereof by which it is hinged to the marginal end of the horizontal member. Each support assembly is foldable towards one another from a rigid, load bearing configuration into a storage configuration to present a small compact package for storage. Each of the support assemblies comprises a bracket at the upper end thereof which is attached to opposed marginal ends of the horizontal member; and an extension member is pivotally attached to the bracket. A latch device is included for latching and unlatching the extension member to the bracket. The support assembly terminates in a base at the lower end thereof, and includes a pair of diverging legs. A novel toggle assembly locks the pivotally attached legs to the lower end of the extension member, so that the legs can be pivoted into a retracted position whereby they are folded toward the bracket and into parallel relationship respective to one another and to the extension member.

14 Claims, 2 Drawing Sheets

FOLDABLE SAWHORSE

BACKGROUND OF THE INVENTION

Sawhorses are known to those skilled in the art as evidence by the patents to Beardsley U.S. Pat. No. 1,261,007; Barras U.S. Pat. No. 3,601,224; Follick U.S. Pat. No. 4,183,317; and Kirkpatrick U.S. Pat. No. 3,738,451. In Beardsley, the sawhorse requires diagonal bracing 22 which supports opposed vertical legs 11. The sawhorse of Beardsley cannot be folded into a convenient package in the manner set forth in this disclosure.

Barras discloses a scaffold having a tripod at the lower end thereof and a bracket assembly at the upper end thereof. Follick discloses a support structure for accommodating a horizontal member 34 within a bracket member 31. The bracket member is formed at the upper end of an elognated support.

Kirkpatrick discloses a sawhorse having a horizontal member at the upper end thereof and a support assembly at opposed marginal ends of the horizontal member. The support assembly can be pivoted towards one another to fold the sawhorse into a compact package.

The present invention differs from the known prior art by the provision of a sawhorse having a horizontal member supported by a support assembly at each end thereof which can be folded into a compact package in a unique and novel manner, and which can be unfolded to provide a rigid and convenient sawhorse for bearing loads in a safe and heretofore unknown manner.

SUMMARY OF THE INVENTION

A sawhorse has a horizontal member supported by a support assembly at each end thereof. The support assembly has an upper end hinged to the marginal ends of the horizontal member. Ech support assembly is foldable into a small package and can further be folded towards one another from a load bearing into a storage configuration.

Each support assembly includes a bracket at the upper end thereof. The bracket is removably attached to the opposed ends of the horizontal member. An extension member is pivotally attached to the bracket and downwardly extends thereof. The extension member is latched to the bracket in order to maintain the extension vertically aligned and rigidly fastened to the rest of the sawhorse structure. The latch means enables the extension to be unlatched from the bracket, and thereby enables the extension to be pivoted into parallel relationship respective to the horizontal member of the sawhorse.

The support assembly terminates in a base, and the base includes a pair of legs. A toggle assembly latches the legs in an operative position. The toggle assembly releases the legs and permits the legs to be pivotally moved about the lower end of the extension member and into parallel relationship respective to one another. Hence, the lower marginal end of the support assembly is foldable onto itself and the resultant structure is foldable onto the horizontal member, thereby presenting a small compact package that enables the sawhorse of the present invention to be stored in a small amount of space.

Accordingly, a primary object of the present invention is the provision of a sawhorse having a support assembly therefor that can be folded into a small package without the necessity of removing any of the parts from the sawhorse.

Another object of the present invention is the provision of a sawhorse having a support assembly pivotally attached thereto, with the lower marginal end of the support assembly being foldable onto itself and the support assembly being folded into horizontal relationship with respect to the remaining components of the sawhorse.

A still further object of this invention is the provision of a sawhorse having an elongated horizontal member, a support assembly at each marginal end of the horizontal member, the support assembly including a bracket connected to the horizontal member, with there being an extension member pivotally attached to the bracket that can be pivoted towards one another into axially aligned relationship respective to one another and in parallel relationship respective to the horizontal member; and with there being a foldable base at the lower marginal end of the support assembly which can be folded back onto itself.

These and various other obejcts and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 2:
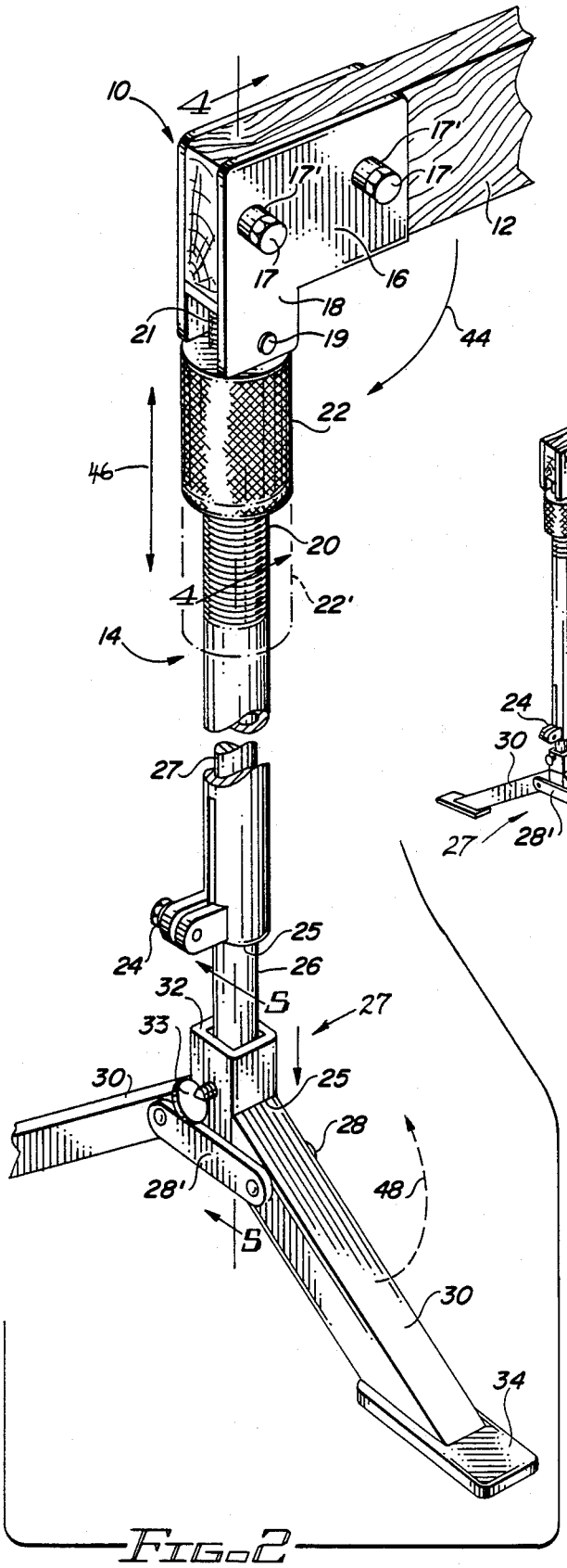
FIG. 2 is an enlarged, fragmentary, detailed view of the sawhorse disclosed in FIG. 1.

In the figures of the drawings, there is disclosed a sawhorse 10 made in accordance with the present invention. The sawhorse has the usual horizontal member 12 which preferably is a 2×4, 2×6, or a square piece of tubing or other suitable load carrying member. A support assembly 14 is attached to the opposed marginal ends of the horizontal member 12. Each support assembly 14 includes a bracket 16 removably affixed to the marginal end of the horzizontal member 12. The bracket includes downwardly depending ears 18 which form a pivot in conjunction with the upper end of an extension member 20. A pivot pin 19 extends through the ears and through the upper end of the extension member.

Figure 1:
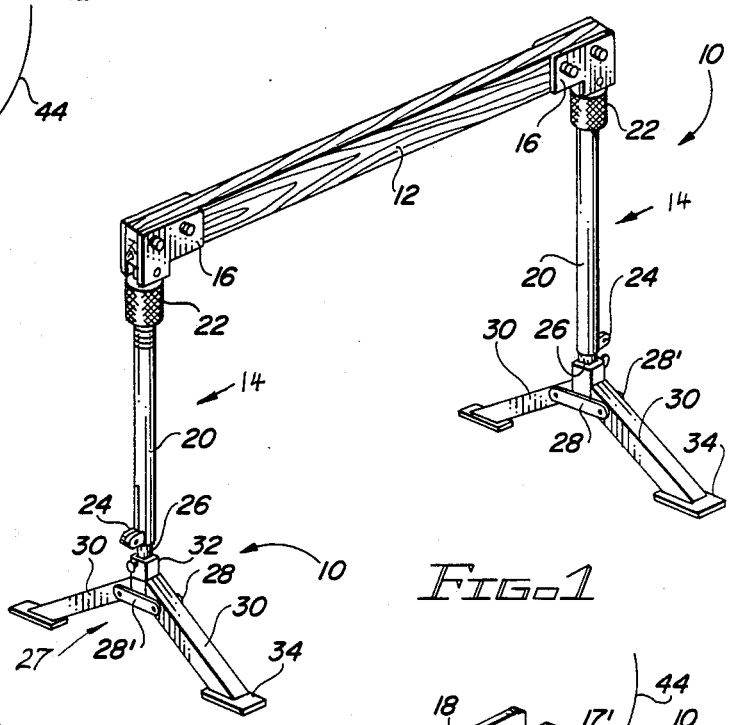
FIG. 1 is a perspective view showing a sawhorse made in accordance with the present invention.
Figure 4:
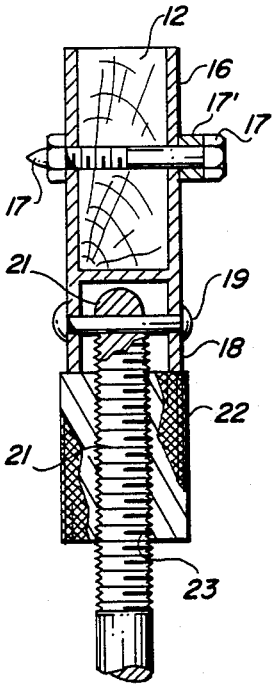
FIG. 4 is an enlarged, fragmentary, part cross-sectional end view of the sawhorse disclosed in FIGS. 1 and 2.
Figure 8:
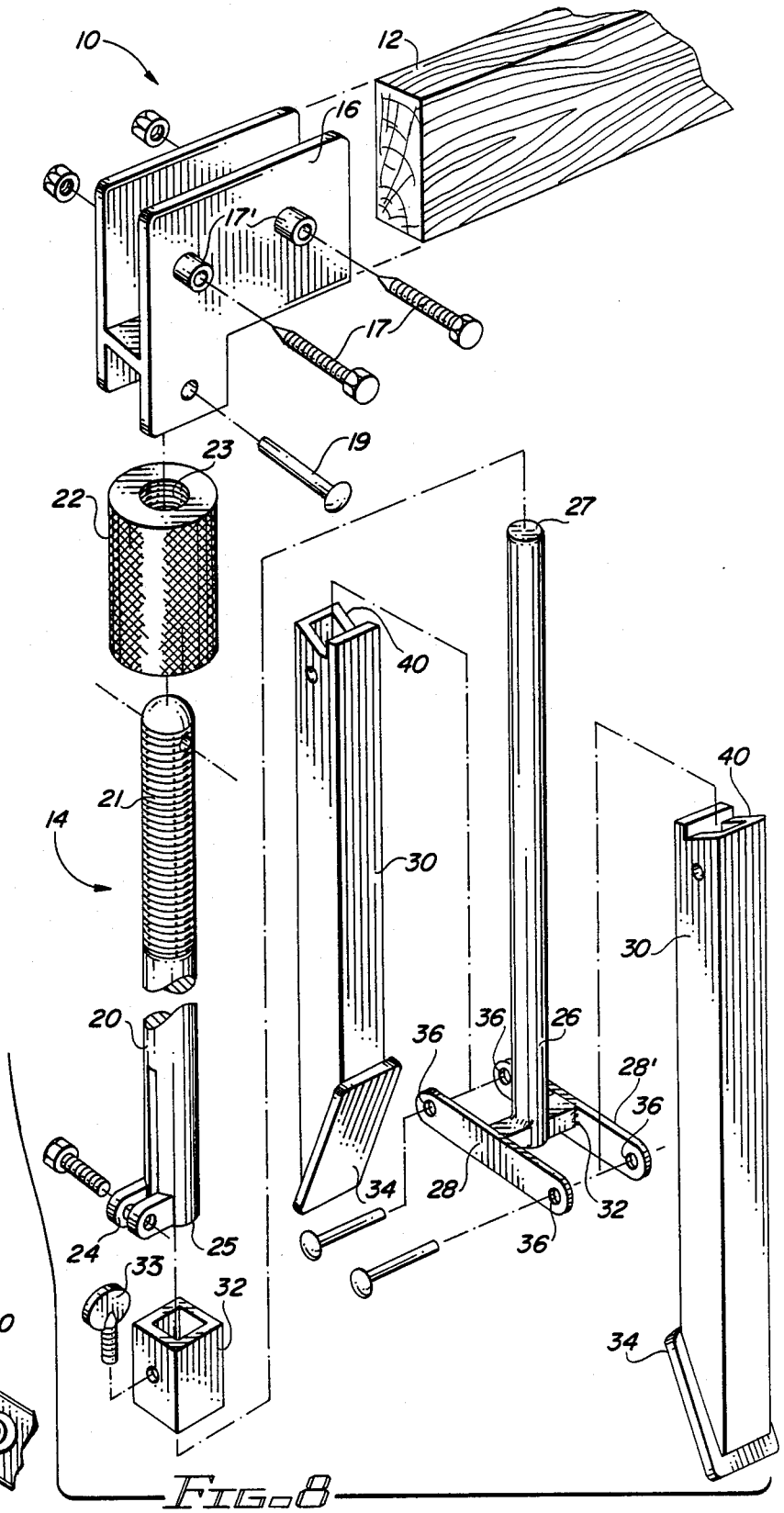
FIG. 8 is an exploded view of the apparatus disclosed in FIG. 2.

In FIGS. 4 and 8, together with other figures of the drawings, the upper marginal end of the extension member 20 is threaded at 21 and thereby threadedly receives an internally threaded annular latch member 22 thereon. The latch member 22 can be screwed into abutting engagement with the lower ends of the ears 18 as seen in FIGS. 1, 2, and 4, thereby latching the extension member 20 to the bracket 16, and latch member 22 can be unscrewed into the released position as indicated by numeral 22' in FIG. 2.

Friction clamp 24 provides a lock which is similar to the clamp associated with a bicycle seat and frame. The clamp 24 is formed near the lower end 25 of the extension 20. Telescoping member 26 is telescopingly received within extension member 20 and extends therewithin to adjust the height of the horizontal member 12 as may be desired.

The lower marginal end of the support assembly 14 is in the form of a base that includes a toggle assembly 27. The toggle assembly 27 includes fixed lateral members 28, 28', opposed diverging legs 30, and a slidable collar 32. The collar 32 has a set screw 33 attached thereto and can be raised vertically upwards as indicated by numeral 32' in FIG. 7. The legs 30 terminate at the lower free end thereof in a foot 34. The near end of the legs 30 are pivotally connected to the free ends of the lateral members 28, 28' of the toggle assembly 27.

Figure 5:
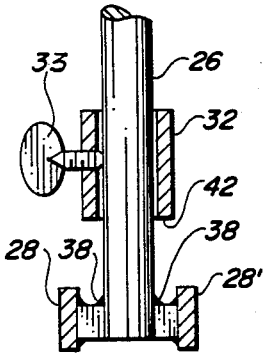
FIG. 5 is a detailed, part cross-sectional view of part of the apparatus taken along line 5—5 of FIG. 2.
Figure 7:
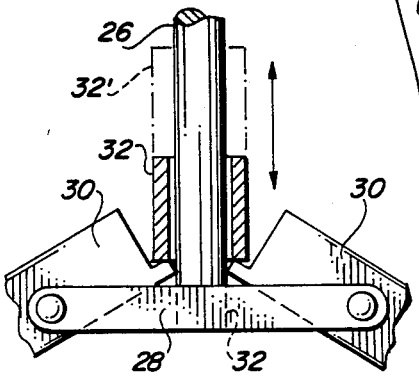
FIG. 7 is an enlarged, fragmentary, detail in part of the apparatus disclosed in some of the foregoing figures.

As seen in FIGS. 2, 7, and 8, the lateral members 28, 28' are welded directly to the lower end of the telescoped member 26 as particularly seen indicated by numeral 38 in FIG. 5. The hinged near or pivoted end 40 of the leg 30 is provided with an inclined surface for receiving the lower edge 42 of the slidable collar 32 in the illustrated manner of FIGS. 7 and 8, thereby providing a lower lock means for the retractable base.

Figure 3:
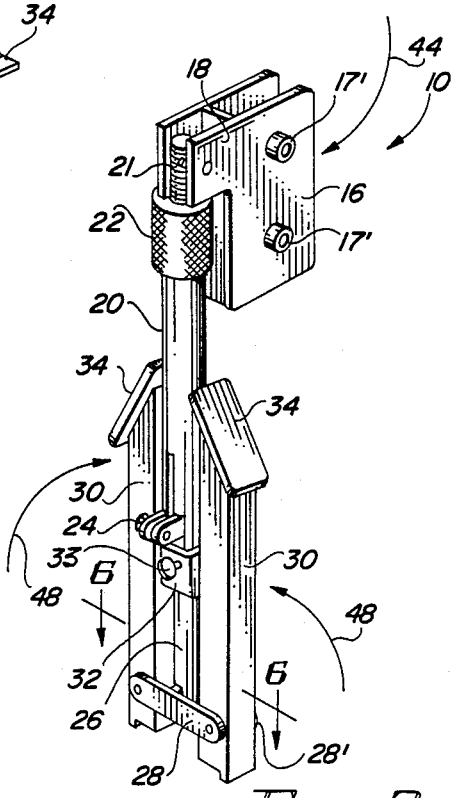
FIG. 3 discloses part of the sawhorse of FIGS. 1 and 2 in a folded up configuration.

Numeral 44 of FIGS. 2 and 3 indicates pivotal movement of the support assembly respective to the bracket 16. Numeral 46 of FIG. 2 indicates the range of adjustment of member 22 respective to telescoping member 26. Numeral 48 of FIG. 2 indicates pivotal movement of legs 30 as they are pivoted into parallel relationship respective to one another and to the extension member 20.

Figure 6:
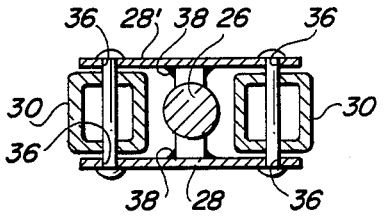
FIG. 6 is an enlarged, cross-sectional, detailed view taken along line 6—6 of the apparatus disclosed in FIG. 3.

In operation, two support assemblies 14 are attached to horizontal member 12 by driving the pointed bolts 17 through the apertured bushing 17' of the bracket 16, and through the opposed hole in the bracket 16. Then the illustrated nuts of FIG. 6 are threadedly made up to the bolt, thereby securely attaching the horizontal member 12 to the spaced apart brackets 16 in the illustrated manner of FIGS. 1, 2, and 4.

Figure 9:
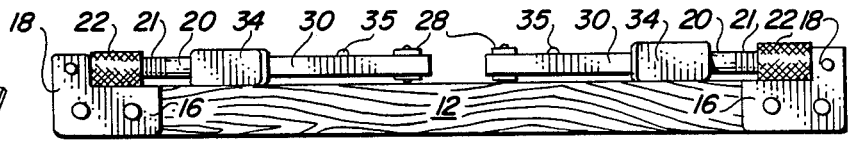
FIG. 9 is a reduced, side elevational, view of the apparatus disclosed in FIG. 1 shown in the folded configuration.

The support assemblies 14 can be folded into the configuration set forth in FIGS. 3 and 9. Each support assembly can be extended into the configuration set forth in FIGS. 1 and 2 when in use. This provides an adjustable but rigid structure having a minimum of appendages extending therefrom that ordinarily prevent freedom of movement about other known sawhorses. As seen in FIGS. 1 and 2, together with other figures of the drawings, each support assembly 14 has the extension 20 thereof rigidly locked to the bracket 16 at each end of the horizontal member 12 by means of the latch member 22 and the locking collar 32, along with the friction clamp 24.

The latch member 22 is threadedly made up into abutting engagement with the lower surface of the spaced ears 18, thereby locking the extension 20 to the bracket 16. The extension 20 is vertically aligned in perpendicular relationship respective to the horizontal member 12. The friction clamp 24 enables the elevation of the horizontal member 12 to be selected by loosening the clamp 24 and telescoping the member 26 from the extension member 20, thereby selecting the overall height of the sawhorse 10.

The locking collar 32 along with the pivoted ends of legs 30, and lateral members 28, 28' form a toggle assembly at the base of the support assembly 14. The legs can be pivoted at 48 towards one another and into parallel relationship respective to one another and to the extension member 20. This is achieved by loosening thumb screw 33 and lifting collar 32 upwards as indicated by numeral 32' in FIG. 7. Next, the feet 34 are pivoted in teh direction of numeral 48, with the near ends of the legs 30 passing each other as they travel through the spaced apart lateral members 28, 38' and the far ends thereof moving towards the bracket 16 and into parallel relationship respective to one another and to the extension member 20.

The pivoted ends 40 of the legs 30 are notched so that the lower end 42 of the collar 32 can be brought into the locked position set forth in FIG. 7. In this position, upward force applied to feet 34 tend to rotate legs 30 in the direction of arrow 48. This motion is resisted by the external surface 40 at the end of each leg 30, wherein the pivoted ends of the legs 30 are brought into engagement with and compress the slidable collar 32 with a scissor-like action so that a load can be transferred from the horizontal member, through the bracket 16, through the extension 20, through the toggle assembly, along the legs 30, and into the feet 34.

In order to store the sawhorse, the legs are folded in the following manner:

The thumb screw 33 is loosened, the slidable collar 32 moved vertically upward at 32' in FIG. 7, the legs 30 are rotated as indicated by numeral 48 into the position of FIG. 3. The latch member 22 is unscrewed to permit the extension to be pivoted respective to the bracket 16 as indicated by numeral 44, thereby placing the sawhorse into the folded up configuration set forth in FIG. 9. When it is desired to use the sawhorse, it is unfolded by reversing the above procedure.

Those skilled in the art, having digested this disclosure, will appreciate at least two legs 30 are required at each assembly 14. The employment of three legs 30 at each assembly 14 is deemed to fall within the comprehension of this invention. Moreover, the horizontal member 12 can be made of tubular metal as well as other configurations and other materials of construction.

I claim:

1. A sawhorse of the type having a horizontal central member supported by a support assembly at each end thereof; each said support assembly having an upper end hinged to the marginal end of the horizontal member, each support assembly is foldable towards one another from a load bearing into a storage configuration to present a small compact package;

each said support assembly comprises a bracket at the upper end thereof which is removably attached to the opposed ends of said horizontal member; an extension member pivotally attached to said bracket, means latching said extension member to said bracket to selectively prevent relative movement therebetween;

said support assembly terminates in a base, said base includes a pair of legs, a toggle assembly by which said legs are pivotally attached to the lower end of said extension member; the legs of each base are pivotally attached to the end of the extension and are foldable towards the extension.

2. The sawhorse of claim 1 wherein said means latching are provided by which the upper end of the extension member is latched to said bracket to prevent pivotal movement thereof; said extension member includes first and second telescoping members that are extended respective to one another to increase the height of the horizontal member.

3. The sawhorse and claim 1 wherein means are provided to lock the legs of the toggle assembly respective to the extension member.

4. The sawhorse of claim 1 wherein said bracket is in the form of a U-shaped cradle member that receives a marginal length of said horizontal member therewithin, ears extending downwardly from said bracket; pivot means by which the upper end of the extension is attached to the ears of the bracket.

5. The sawhorse of claim 4 wherein said horizontal member is made of wood; apertures on opposed sides of said bracket; a bolt having a pointed end which can be extended through the apertures and through the horizontal member and thereby bolt the horizontal member and bracket together.

6. The sawhorse of claim 4 wherein said toggle assembly includes a lateral member affixed to the lower end of said extension member; means by which said pair of legs are pivotally connected to opposed ends of said lateral member; and means for locking the legs to the lower end of said extension.

7. In a sawhorse having a horizontal central member supported at each end thereof by a support assembly; the improvement comprising:

each said support assembly having a hinge formed at an upper end thereof by which it is hinged to the marginal end of the horizontal member, each support assembly is foldable towards one another from a load bearing into a storage configuration to present a small compact package for storage;

each said support assembly comprises a bracket at the upper end thereof which is attached to opposed marginal ends of said horizontal member; an extension member pivotally attached to said bracket, means for latching and unlatching said extension member to said bracket; and support assembly terminates in a base at the lower end thereof;

said base includes a pair of diverging legs, a toggle assembly by which said legs are pivotally attached to the lower end of said extension member and can be pivoted into a retracted position wherein the legs are folded toward the bracket and into parallel relationship respective to one another and said extension member.

8. The sawhorse of claim 7 wherein latch means are provided by which the upper end of the extension member is latched to said bracket.

9. The sawhorse of claim 7 wherein said toggle assembly includes a lock by which said legs are releasably locked together and to the extension member.

10. The sawhorse of claim 7 wherein said bracket is in the form of a U-shaped member that receives said horizontal member therewithin, ears extending downwardly from said bracket; pivot means by which the upper end of the extension is attached to the bracket.

11. The sawhorse of claim 7 wherein said horizontal member is made of wood; apertures on opposed sides of said bracket; a bolt having a pointed end which can be extended through the apertures and through the horizontal member and bolted into position.

12. The sawhorse of claim 7 wherein said base includes means by which said toggle assembly and said legs are releasably locked together and to the extension member; said toggle assembly includes a lateral member affixed to said extension member; said legs have a hinged end pivoted to the ends of the lateral member; and a lock member for engaging and locking the legs to the lower end of the extension.

13. In an apparatus such as a sawhorse of the type having a horizontal central member supported by a support assembly at each end thereof; the improvement comprising:

said support assembly having an upper end hinged to the marginal end of the horizontal member, said support assembly is foldable towards the medial part of the horizontal member from a load bearing into a storage configuration to present a small compact package;

each said support assembly comprises a bracket at the upper end thereof which can be removably attached to the opposed ends of the horizontal member; and, an extension member pivotally attached to said bracket, means latching said extension member to said bracket to selective prevent relative movement therebetween;

said support assembly terminates in a base, said base includes a pair of legs, a toggle assembly by which said legs are pivotally attached to the lower end of said extension member;

said legs of each base is pivotally attached to the end of the extension for movement away from one another and said legs are foldable towards the extension.

14. The improvement of claim 13 wherein said toggle assembly of said base includes means by which said legs are releasably locked together and to the extension member; said toggle assembly includes a lateral member affixed to said extension member; said legs have a hinged end pivoted to the ends of the lateral member; and a lock member for engaging and locking the legs to the lower end of the extension.

* * * * *